United States Patent [19]

Brefka

[11] 3,934,727

[45] Jan. 27, 1976

[54] PILFER-PROOF MERCHANDISE DISPLAY

[75] Inventor: Paul Brefka, Boston, Mass.

[73] Assignee: Henry L. Hanson Co., Inc., Worcester, Mass.

[22] Filed: Nov. 18, 1974

[21] Appl. No.: 524,500

[52] U.S. Cl. ..... 211/7; 211/57; 248/DIG. 3; 248/203

[51] Int. Cl.[2] ..... E05B 73/00

[58] Field of Search ..... 211/4, 7, 8, 9, 54, 57, 211/59; 248/DIG. 3, 203; 206/806; 312/118, 184, 189, 234; 70/59, 60, 61, 62; 221/29

[56] References Cited

UNITED STATES PATENTS

| | | | |
|---|---|---|---|
| 810,829 | 1/1906 | Ward | 211/59 |
| 3,622,011 | 11/1971 | Snow | 248/203 |
| 3,735,875 | 5/1973 | Parillo | 211/7 |
| 3,785,501 | 1/1974 | Canning | 211/7 |
| 3,799,357 | 3/1974 | Govang | 248/DIG. 3 |
| 3,841,478 | 10/1974 | Wells et al. | 206/806 |

FOREIGN PATENTS OR APPLICATIONS

| | | | |
|---|---|---|---|
| 347,890 | 5/1931 | United Kingdom | 211/7 |

*Primary Examiner*—Roy D. Frazier
*Assistant Examiner*—Robert A. Hafer
*Attorney, Agent, or Firm*—Charles R. Fay

[57] ABSTRACT

A merchandise display utilizing a pegboard hook supporting a plurality of cards upon which merchandise is mounted, and a fixed position bracket or the like mounted on a background member on the hook, said bracket having a hinged cover which is very simply manually locked in position preventing the removal of any of the cards containing the merchandise until the lock is unlocked.

14 Claims, 5 Drawing Figures

PILFER-PROOF MERCHANDISE DISPLAY

BACKGROUND OF THE INVENTION

Merchandise displays, particularly for small articles, have developed into hook or peg supported cards upon which the merchandise is individually mounted. Many such displays are for self-service but since the cards and the merchandise are relatively small they lend themselves to shoplifting; and it is the object of the present invention to provide a relatively simple device for avoiding such shoplifting and making it necessary, in order to remove any of the merchandise, to unlock it so that the cards are released and may be removed.

SUMMARY OF THE INVENTION

An elongated hook is applied to a perforated board and a snubber or stabilizing clip which is the subject matter of U.S. Pat. No. 3,813,070, May 28, 1974 is utilized to hold this elongated hook in horizontal condition and against sagging. A background plaque having an opening in it in a predetermined location is slid onto the hook to the perforated board, and at its rear surface it has a pair of projections which enter corresponding perforations in the pegboard holding the plaque against tilting. The background plaque has on its front surface a pair of pins and associated therewith is a flange which is inclined relative to the horizontal. The flange and the pins are in fixed position on the background plaque.

An elongated bracket is provided with apertures at one end to receive the pins referred to, and a similarly pinned cap is mounted on the bracket at the other end. The bracket extends horizontally forwardly at right angles to the plaque.

Pivotally mounted along the entire length of the bracket is a locking cover which has an elongated tab which is normally located within the bracket. A simple manually operated lock mounted on the exterior of the bracket extends through the same into engagement with the tab on the pivoted cover, locking the same in position. The bracket and the pivoted cover are mounted on the background plaque in such a way as to ensure that the hook which supports the merchandise is in very close association with the pivoted cover when it is in locked position; and the merchandise is mounted on cards having side opening hooks and bights adjacent the top edge portions of the cards. The top edge of each card is adjacent to and practically in contact with the lower surface of the pivoted cover which has an elongated side flange embracing the cards at the top edge portions thereof, and the result is that none of the cards can be slid off the hook because of the end cap and they cannot be lifted because of the pivoted cover. They can only be released without damage when the lock is unlocked and the pivoted cover is raised.

PREFERRED EMBODIMENT OF THE INVENTION

Figure 1:
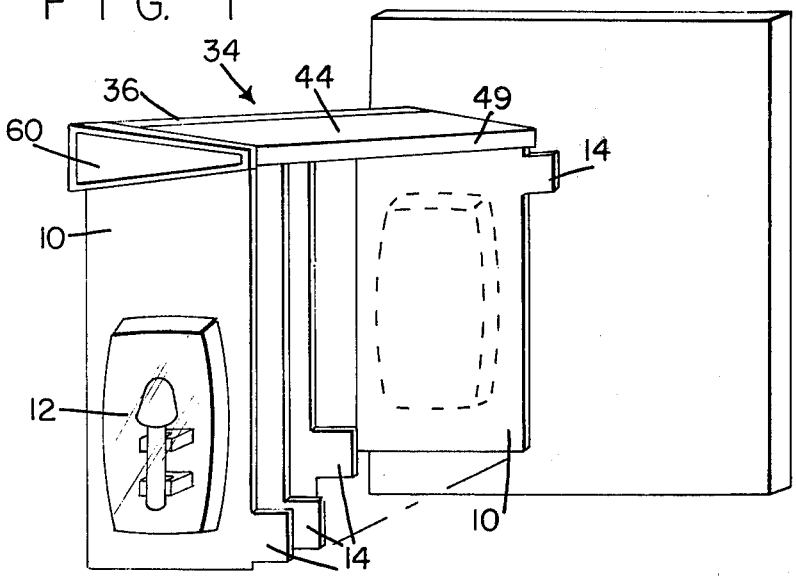
FIG. 1 is a perspective view illustrating the invention with all the parts in position for display.

The merchandise display card used to illustrate this invention is generally according to that disclosed in copending application Ser. No. 374,668, filed June 28, 1973, for MERCHANDISE DISPLAY, now U.S. Pat. No. 3,870,144. This is here shown in FIG. 3 wherein the card 10 bears a ripoff box 12 containing the merchandise and a tab 14 which has some description or identification of the merchandise thereon. At the top edge of the card it is provided with a left-opening bight 16 forming a hook 18 and the top edge of the card is slanted down to the right as shown at 20. The bight is undercut or recessed top and bottom as at 21, 21. A plurality of these cards are mounted on an elongated hook 22 in the arrangement shown in FIG. 1 where the tabs are offset from each other so that regardless of the number of cards with different types of merchandise, the same can be identified at a glance.

The reference numeral 24 indicates a perforated board upon which the elongated hook 22 is mounted in the usual way except that the snubber or stabilizing clip 26 (U.S. Pat. No. 3,813,070) is utilized to hold the hook 22 in a horizontal fixed position so that it does not tend to sag as usually happens when the hooks are as long as indicated herein and mount several cards.

A background plaque which may contain advertising and description of the merchandise is provided with a hole 28 receiving rod 22 and at its rear surface is provided with two rearwardly extending projections 30, 30 which extend into corresponding holes in the pegboard 24 thereby anchoring the background plaque solidly in position on the pegboard.

At its front face the background plaque is provided with a pair of vertically spaced forwardly projecting pins 32 and a flange 34 which inclines downwardly and to the right just above the hook 22.

An elongated bracket which has the general form of an angleiron is generally indicated at 34. This bracket has a generally horizontal top portion 36 and a generally vertical side portion 38. All along the exposed edge of top portion 36 there is a cylindrical rod-like edge 40. At the inner aspect of the vertical side 38 there is an aperture or the like in a projection indicated at 42, and a similar aperture is provided at 43 at the junction of the top 36 and the side 38. This construction is repeated at the opposite end of the device for the press-fit reception of pins 32 holding bracket 34 in the FIG. 1 position with one end snugly against the background plaque. Inasmuch as it is convenient to manufacture the bracket by extrusion, the openings 42 and 44 may extend the full length of the bracket, but they are used only at the ends thereof.

Figure 2:
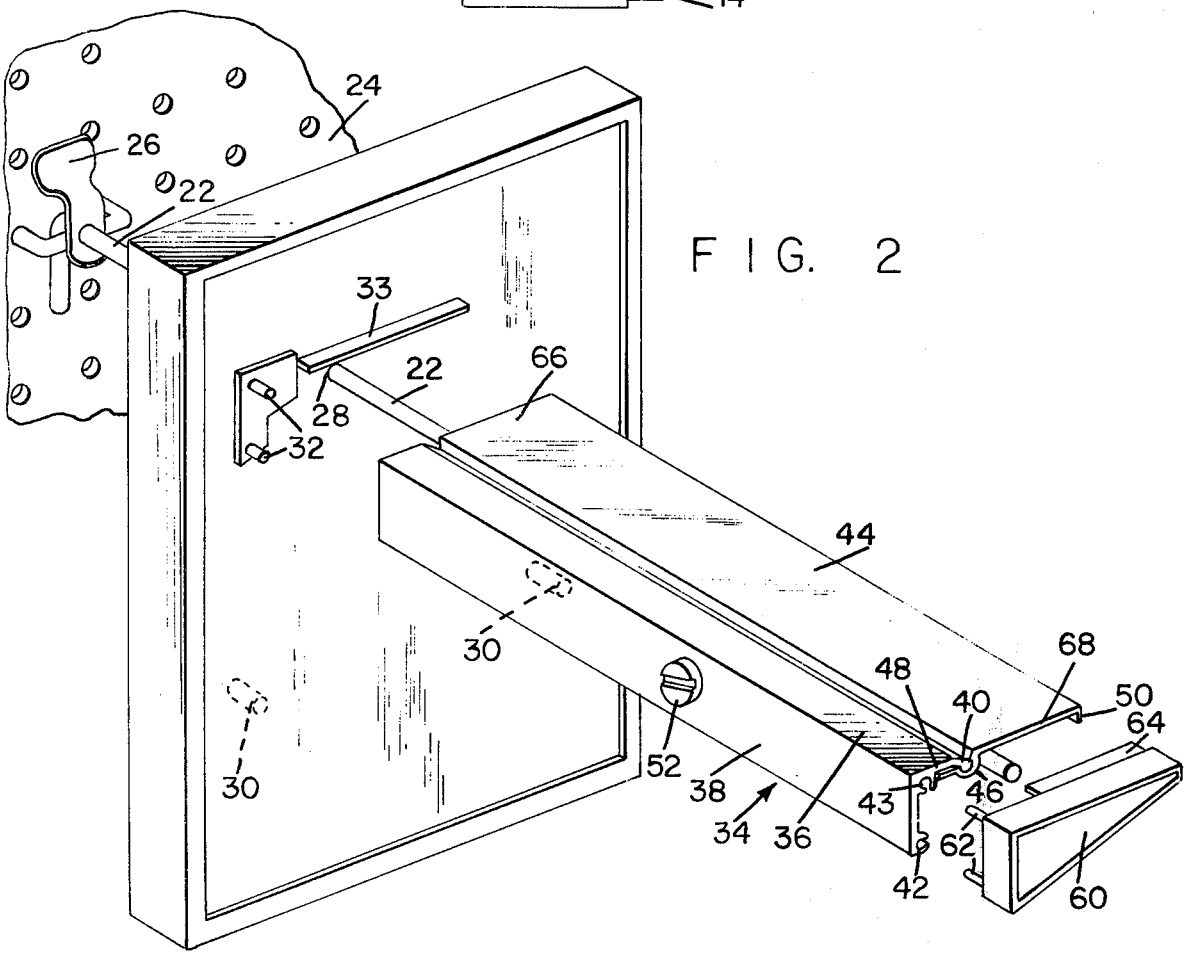
FIG. 2 is an exploded perspective view illustrating the parts in more detail.

An elongated hinged cover member 44 which is as long as the bracket, is provided adjacent one end with a continuous semicylindrical ferrule 46 which is slidably received on the cylindrical rodlike edge 40 and encompasses it past the diameter of the latter so that when slid on it it cannot be taken off or removed in a lateral direction. At the inner side edge portion of the ferrule it is provided with a continuous tab 48. The tab 48 holds the hinged cover 44 in the position shown in FIGS. 1, 2, and 4, and the rodlike edge 40 acts as a hinged pivot so that the cover can be raised, i.e., pivoted upon member 40, see FIG. 3. The cover has an edge flange 50. The top edges 20 of the cards 10 are in close association with respect to the undersurface of cover 44 and due to the flange 50 and the construction of the hook 18 and the bight 16, see FIG. 3, it is not possible to remove a card without raising the cover without violently breaking the cards which are preferably made of a relatively heavy plastic material.

Figure 3:
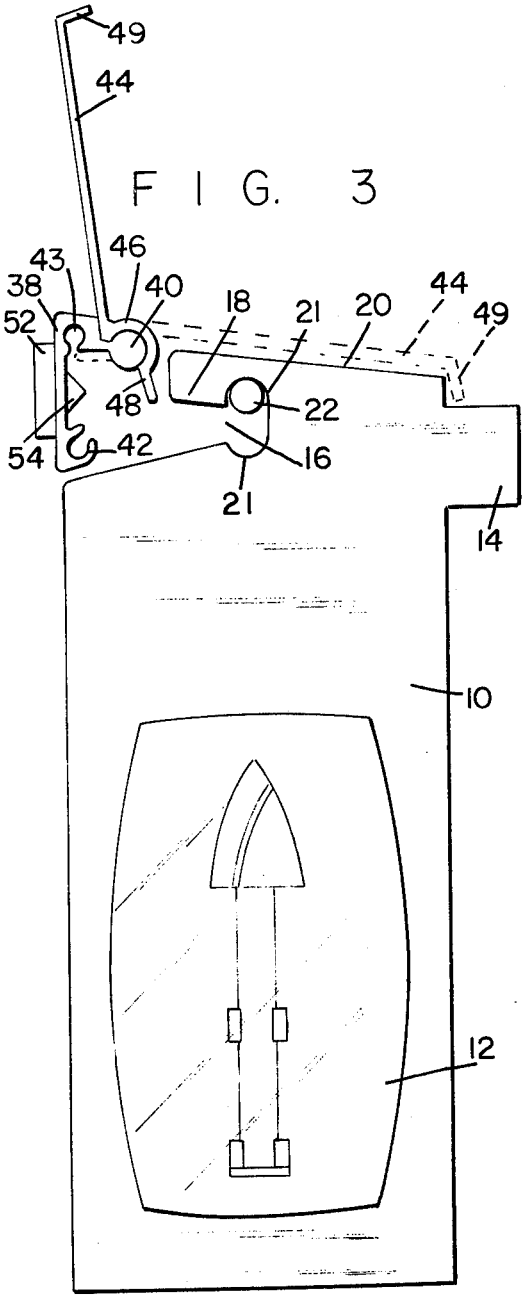
FIG. 3 is an end view of the bracket and hinged cover with the end cap removed showing the relationship of the merchandise cards with respect to the hinged cover, and the cover being unlocked.
Figure 4:
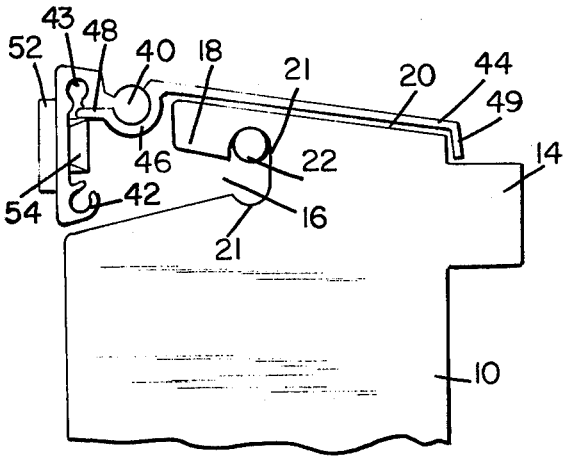
FIG. 4 is a similar view showing the cover locked.
Figure 5:
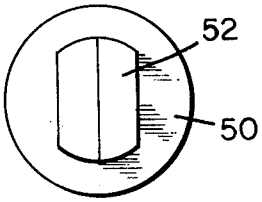
FIG. 5 is an enlarged view of the lock.

FIGS. 3–5 illustrate the locking member 52 which is rotated by a coin or screwdriver between locking and unlocking position with respect to tab 48. The part 52 is exposed for this purpose and inside the bracket, the locking member is secured to a triangular lock part 54 rotatable therewith. With the inner lock part 54 vertical, FIG. 4, the cover 44 cannot be raised because the tab strikes this lock part, but with lock part 54 horizontal, the tab can swing part it.

Although a coin or tool operated lock can be utilized, obviously a lock operable with a key could be used as well.

Finishing off the structure there is an end cap 60 having pins 62 which are the same as but opposite to pins 32 and which are press fitted into the openings 42, 44 for substantially permanent association with the bracket. There is also a rearwardly directed flange 64 on the cap comparable to that at 34 and complementary thereto, upon which the edges of the cover 44 as at 66 and 68 are adapted to rest in the closed locked position of cover 44. The cards therefore cannot be slid along and off the hook 22, the latter continuing to the inside surface of the cap.

I claim:

1. Display apparatus for merchandise mounted on cards, comprising an elongated hook member, a generally planar vertical support for the hook, means holding the hook on the support a plaque mounted on said hook members, said plaque in a plane generally parallel to said support generally horizontal and at right angles to the support, a plurality of cards mounted on said hook member, an elongated bracket, extending in a direction generally perpendicular to said plane of said support, one end of said bracket mounted on said plaque, the hook and bracket terminating in free ends adjacent to each other, a pivotable cover on the bracket, the cover being coextensive with the bracket and the hook, means hinging the movable cover along the bracket, said cover having one position in close association with the hook and the top edges of said cards and a pivoted position freeing the same, the cards and cover being constructed and arranged to allow removal of the cards from said hook only upon the movement of said cover to card freeing position, and means on said bracket temporarily securing said cover in locked position adjacent to the top edges of said cards.

2. The merchandise display of claim 1 wherein the cover hinging means is arranged along a long edge of the bracket.

3. The merchandise display of claim 1 including means maintaining said cover in a slanted position when covering the merchandise cards, the latter having corresponding inclined top edges.

4. The merchandise display of claim 2 wherein each of the cards has a side opening hook and bight for mounting on the elongated hook member.

5. The merchandise display of claim 4 wherein the top edges of the cards are inclined in conformance with the inclination of the slanted cover.

6. The merchandise display of claim 5 including a longitudinal edge flange on the cover preventing lateral removal of the cards.

7. The merchandise display of claim 1 including said background plaque with the means for mounting the bracket being on said plaque at the forward face thereof.

8. The merchandise display of claim 7 including means on the background plaque for mounting on the hook and means at the rear surface of the plaque for engagement with spaced holes in a perforated board.

9. The merchandise display of claim 7 wherein the means for mounting the bracket comprises a pair of spaced pins on the plaque, the bracket including complementary spaced openings for a press-fit therewith, said pins and said bracket being substantially horizontal.

10. The merchandise display of claim 9 including an end cap for said bracket.

11. The merchandise display of claim 10 including an inclined flange on the end cap and an inclined flange at the opposite end thereof adjacent the pins for holding the hinged cover in slanted position.

12. The mechandise display of claim 1 wherein said hinged cover is provided with an inwardly directed tab at the opposite side of the pivot axis from the main body portion of the cover, and a lock engaging said tab in locked position thereof and releasing it in unlocked position.

13. A merchandise display for a perforated board comprising an elongated hook adapted to be mounted on said perforated board, a stabilizer on said hook holding the same in sustantially horizontal position, a background plaque, means for mounting the same on said hook and on said perforated board, a pair of vertically spaced pins on the front face of said plaque, an elongated bracket having apertures receiving said pins mounting the bracket in horizontal position extending at a right angle from said background plaque, a generally cylindrical rodlike member at an edge of said bracket extending generally the length thereof, and a lock on said bracket, a cover, means on said cover hinging the same with respect to said rodlike member, the main portion of the cover extending away from the bracket, a tab on said cover extending to the opposite side of said rodlike member from the main portion of the hinged cover, means on said bracket forming an abutment against which the tab abuts holding the cover in position covering said hook, said lock engaging said tab and holding the cover in locked position, said lock being actuatable to release the tab to allow the cover to be raised to expose the hook, and an end cap on the bracket covering the terminal end portion of said hook.

14. The merchandise display of claim 13 including a flange on the main portion of the cover at its edge remote from the bracket.

* * * * *